US010627074B2

(12) United States Patent
Drueppel et al.

(10) Patent No.: US 10,627,074 B2
(45) Date of Patent: Apr. 21, 2020

(54) LIGHTING DEVICE FOR VEHICLES

(71) Applicant: Hella GmbH & Co. KGaA, Lippstadt (DE)

(72) Inventors: Mathias Drueppel, Lippstadt (DE); David Duhme, Lippetal (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/298,544

(22) Filed: Mar. 11, 2019

(65) Prior Publication Data

US 2019/0277473 A1 Sep. 12, 2019

(30) Foreign Application Priority Data

Mar. 9, 2018 (DE) ..... 10 2018 105 430

(51) Int. Cl.
*F21S 45/47* (2018.01)
*F21S 41/32* (2018.01)

(52) U.S. Cl.
CPC ..... *F21S 45/47* (2018.01); *F21S 41/32* (2018.01)

(58) Field of Classification Search
None
See application file for complete search history.

(56) References Cited

U.S. PATENT DOCUMENTS

2004/0125343 A1* 7/2004 Hara ..... G03B 21/16 353/57
2013/0044504 A1* 2/2013 Ushio ..... B60Q 1/0094 362/520
2013/0258689 A1 10/2013 Takahira et al.
2017/0328535 A1 11/2017 Yagi et al.
2018/0149952 A1* 5/2018 Matsumoto ..... G03B 21/005

FOREIGN PATENT DOCUMENTS

| | | | |
|---|---|---|---|
| AT | 518094 | A1 | 7/2017 |
| AT | 518220 | A1 | 8/2017 |
| DE | 10344173 | A1 | 4/2005 |
| EP | 2952383 | A1 | 12/2015 |

* cited by examiner

*Primary Examiner* — Ashok Patel
(74) *Attorney, Agent, or Firm* — Muncy, Geissler, Olds & Lowe, P.C.

(57) ABSTRACT

A lighting device for vehicles having a housing, in which a light source unit for emitting a light beam and an optical unit associated with the light source unit for generating a predetermined light distribution are disposed, with a cover plate closing an opening of the housing and with a cooling element for dissipating heat from the light source unit. The cooling element is associated with a heat-dissipating optical element of the optical unit. A dividing wall separating the housing into a first chamber and into at least a second chamber is provided, wherein in the first chamber, the first cooling element associated with the light source unit, and in the second chamber, the second cooling element associated with the heat-dissipating optical element of the optical unit are arranged.

13 Claims, 3 Drawing Sheets

LIGHTING DEVICE FOR VEHICLES

This nonprovisional application claims priority under 35 U.S.C. § 119(a) to German Patent Application No. 10 2018 105 430.0, which was filed in Germany on Mar. 9, 2018, and which is herein incorporated by reference.

BACKGROUND OF THE INVENTION

Field of the Invention

The present invention relates to a lighting device for vehicles comprising a housing, in which a light source unit for emitting a light beam and an optical unit associated with the light source unit for generating a predetermined light distribution are arranged, with a cover plate closing an opening of the housing and with a cooling element for dissipating heat from the light source unit.

Description of the Background Art

From EP 2 952 383 A1, a lighting device for vehicles having a housing is known. In the housing, a light source unit and an optical unit are arranged, by means of which a predetermined light distribution can be generated. The light distribution generated hereby can, for example, be part of a predetermined low beam and/or high beam light distribution. The light source unit has a light source that involves a thermal power loss. The light source is therefore associated with a cooling element, by means of which heat dissipation from the light source is made possible. If the optical unit not only has a reflector or a number of lenses, but a heat-dissipating optical element such as a DMD chip (digital mirror device), which involves a thermal power loss greater than zero, then a plurality of heat dissipating components is disposed within the housing.

From DE 103 44 173 A1, for example, an optical element to be cooled can be designed as a micromirror array (DMD chip). A cooling element associated with the micromirror array allows for heat dissipation thereof.

However, in the conventional art, when the thermal power loss of the light source is greater than the thermal power loss of the micromirror array, the cooling requirement for the micromirror array is increased disproportionately, which leads to a need for increased installation space for the cooling element.

SUMMARY OF THE INVENTION

It is therefore an object of the present invention to provide. a lighting device for vehicles comprising a plurality of heat-dissipating components with different functions, which are arranged in a common housing, in such a way that improved heat dissipation from the components is ensured in a space-saving and effective manner.

To achieve this object, a heat-dissipating optical element of the optical unit is associated with a cooling element, that a dividing wall separating the housing into a first chamber and into at least a second chamber is provided, wherein in the first chamber, the first cooling element associated with the light source unit, and in the second chamber, the second cooling element associated with the heat-dissipating optical element of the optical unit are arranged, and wherein the light beam can be guided in the light current direction from the light source unit via the heat-dissipating optical element to the cover plate.

According to an exemplary embodiment of the invention, a dividing wall is provided inside the housing, which extends in such a way that a plurality of chambers, preferably a first chamber and a second chamber, are formed, wherein in the first chamber, a first cooling element associated with the light source, and in the second chamber, a cooling element associated with the heat-dissipating optical element of the optical unit are disposed. The invention thus achieves a thermal decoupling of the plurality of heat-dissipating components or parts within the housing. The dividing wall may be arranged such that the geometric configuration of the chamber thereby produced brings about an optimal adjustment of the cooling element to the component to be cooled. When, for example, an LED light source is arranged in the first chamber, and a heat-dissipating optical element with a lower thermal power loss is arranged in the second chamber as the LED light source, the cooling element associated with the heat-dissipating optical element can be dimensioned smaller since as a result of the heat insulating dividing wall the temperature in the second chamber can be maintained lower than the temperature in the first chamber. Due to the comparatively low temperature in the second chamber, the effectiveness of the heat-dissipating optical element can be improved or the service life of the same extended.

The dividing wall can be designed such that the first chamber is hermetically separated from the second chamber. Advantageously, thereby an unambiguous thermal separation between the first chamber and the second chamber can be brought about in such a way that, for example, different temperature zones, namely a first temperature zone in the first chamber and a second temperature zone with a temperature that is reduced or elevated as compared to the first chamber, are formed in the second chamber.

The dividing wall can have a resilient tab at a free end, which rests against a wall or an edge of the light source unit and/or the optical unit. Due to its resilience, the resilient tab may conform to the edge or wall so that there is a hermetic separation between the first chamber and the second chamber. The resilient tab may be formed, for example, on a relatively rigid base portion of the dividing wall. Alternatively, the dividing wall may be designed completely resilient and/or flexible when fastening means are arranged on the wall or the edge, which hold the free end of the dividing wall in a fixing position. For this purpose, the fastening means may be designed as a groove in which the free end of the flexible dividing wall engages.

The resilient flap or the entire dividing wall can be arranged and formed of a rubber material. Advantageously, tracking of the movably arranged wall or edge of the light source or optical unit can take place. When the light source unit and the optical unit, for example, form a light module that is pivotally mounted about a horizontal axis towards the headlight range adjustment system, the resilient end of the dividing wall, or the entirely resiliently formed dividing wall can track the movement of the light module, wherein airtightness between the first chamber and the second chamber is consistently ensured.

The dividing wall can be integrally connected to the housing. For example, the dividing wall can be manufactured together with the housing by injection molding. Advantageously, thereby production costs can be reduced.

The dividing wall can be arranged transversely to the main emission direction of the lighting device, wherein said dividing wall is disposed circumferentially relative to the main emission direction and in a plane of extension. The dividing wall thus forms an annular surface with a central opening, within which light-function-related components are arranged.

The dividing wall can extend transverse to the main emission direction of the lighting device, wherein a plurality of dividing wall sections is arranged offset to one another in the main emission direction. Such an offset arrangement of dividing wall portions is ideal for geometrically complex light modules or wide-ranging components. If the light module or the component has walls aligned in different directions or has an asymmetric geometry, the dividing walls may be segmented and arranged in such a position that the free end of the dividing wall is in optimal contact with the wall of the light module.

The dividing wall can be made of plastic or of a glass material, for example, of carbon fiber reinforced synthetic material. Since the dividing wall is arranged in a light-bundle-free region of the housing, the dividing wall can be designed opaque. Alternatively, the dividing wall may also be designed to be translucent.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
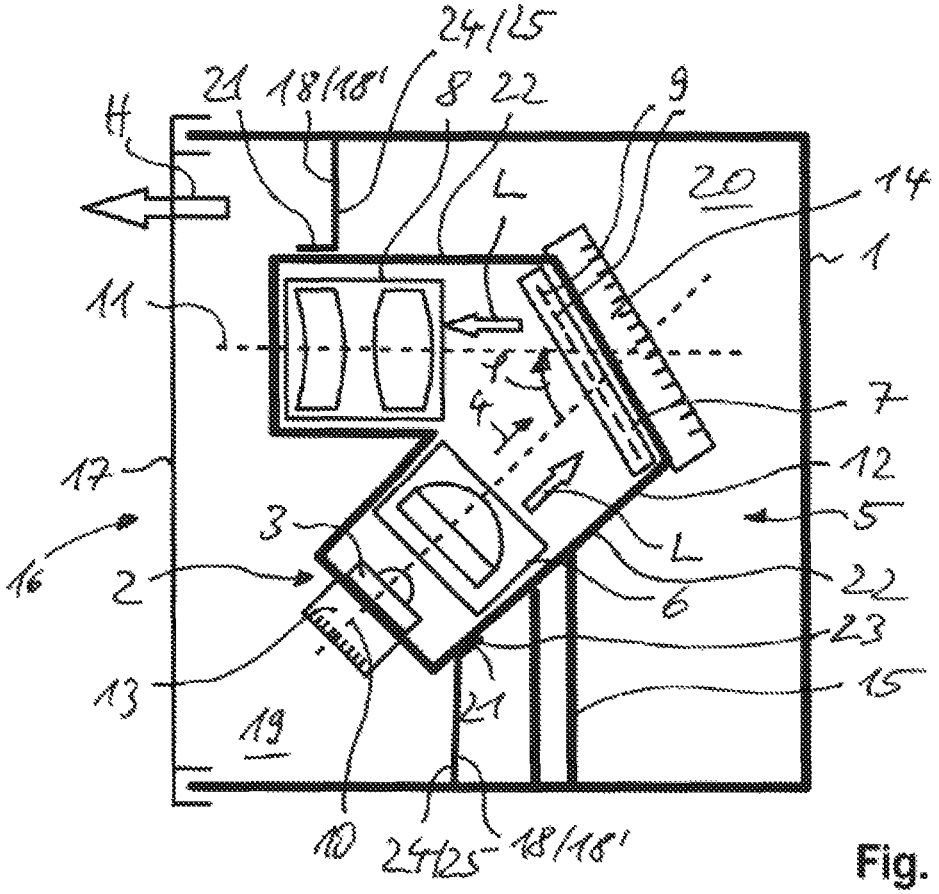
FIG. 1 is a schematic representation of an inventive lighting device according to an exemplary embodiment.

A lighting device for vehicles is preferably designed as a headlight for generating a predetermined light distribution, for example, a low beam distribution, a high beam distribution, an urban light distribution or the like.

The headlight includes a housing 1 in which a light source unit 2 comprising a light source 3 for emitting a light beam 4 and an optical unit 5 for generating a predetermined light distribution are arranged. An opening 16 of the housing 1 disposed forwardly in the main emission direction H of the headlight is closed by a preferably crystal-clear cover plate 17.

The optical unit 5 has an illumination optics 6, a micromirror array 7 disposed light-downstream thereof as a heat-dissipating optical element, and a projection optics 8 disposed light-downstream of the micromirror array 7, wherein the light beam 4 emitted by the light source 3 is guided in the light current direction L from the light source unit 2 via the heat-dissipating optical element 7 to the cover plate 17. The illumination optics 6 is arranged light-downstream of the light source 3 and is located between the light source 3 and the micromirror array 7. The illumination optics 6 may comprise a number of lenses, so that a light beam 4 emitted by the light source 3 is parallelized and collected onto the micromirror array 7.

The micromirror array 7 has a plurality of micromirrors 9, which are arranged in a common surface or plane. The micromirrors 9 in a thus formed DMD array (micromirror array 7) are arranged electronically adjustable between two defined positions. In an operative position of the micromirrors 9, a light beam 4 impinging on the same is reflected at an acute angle in the direction of the projection optics 8. In a second absorber position of the micromirrors 9, the light beam 4 is deflected at a relatively large acute angle away from a perpendicular of the micromirror array 7 to an absorber, not shown.

An optical axis 10 of the illumination optics 6 extends at an acute angle φ to an optical axis 11 of the projection optics 8, or the optical axis 10 of the illumination optics 6 meets the micromirror array 7 at an acute angle φ, so that the optical axis 11 of the projection optics is likewise arranged at an acute angle to the micromirror array 7.

The projection optics 8 may include a plurality of lenses which are arranged on the common optical axis 11.

The illumination optics 6, the micromirror array 7 and the projection optics 8 are disposed or fastened in a common module housing 12. Preferably, the light source unit 2 is also attached to the module housing 12. The light source unit 2 may comprise a single light source 3 or a plurality of light sources. Preferably, the light source 3 is designed as an LED light source (LED chip).

For cooling the light source unit 2, a first cooling element 13 is associated with the same, and for cooling the micromirror array 7, a second cooling element 14 is assigned to the same. The first cooling element 13 and/or the second cooling element 14 may likewise be fastened to the module housing 12.

Preferably, the module housing 12 is pivotally mounted on the housing 1 about a horizontal axis 1 via a module support 15. Depending on the driving situation, the headlight range or the light module range thus formed can be adjusted by pivoting the module housing 12.

The first cooling element 13 is used for dissipating heat from the light source unit 2. The second cooling element 14 is used for dissipating heat from the micromirror array 7.

The micromirror array 7 is arranged on a side of the module support 15 facing away from the cover plate 17.

In order to prevent unwanted heating of the micromirror array 7, a dividing wall 18 is provided which divides the housing 1 into a first chamber 19 and into a second chamber 20 adjacent thereto. The first cooling element 13 is located in the first chamber 19. The second cooling element 14 is located in the second chamber 20. The dividing wall 18 thus extends in a range between the first cooling element 13 and the second cooling element 14.

Figure 2:
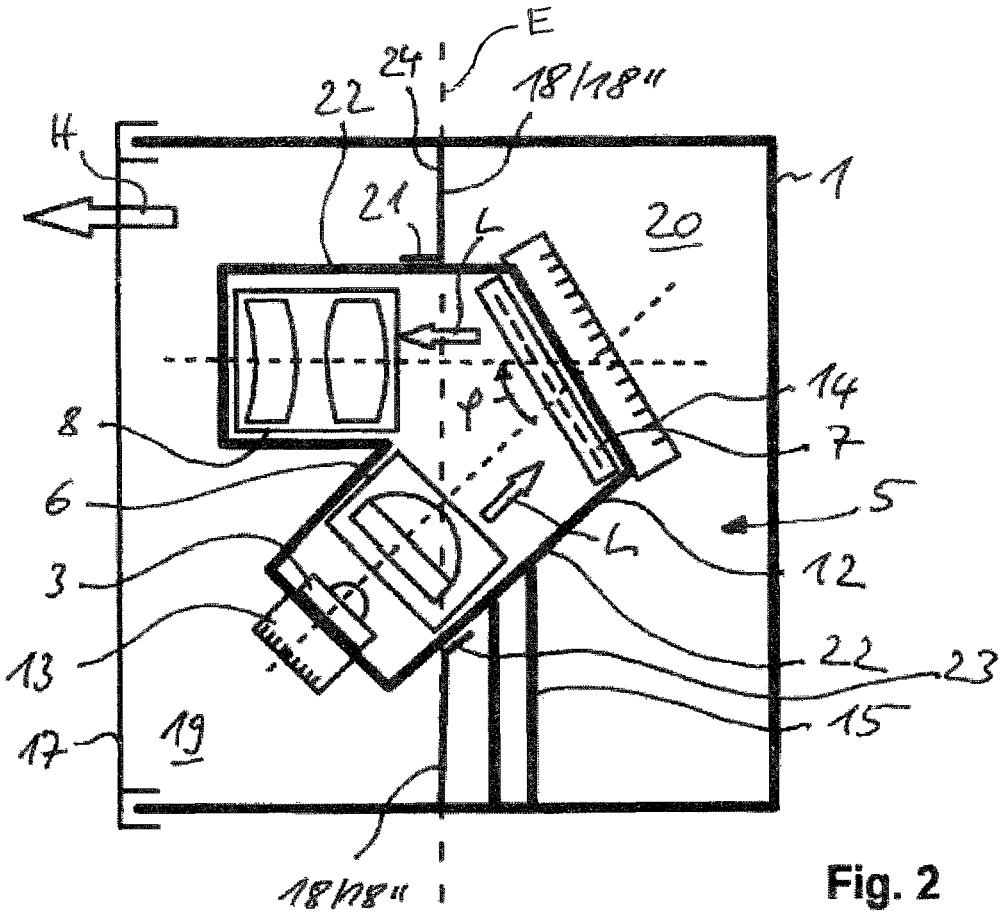
FIG. 2 is a schematic representation of an inventive lighting device according to an exemplary embodiment.
Figure 3:
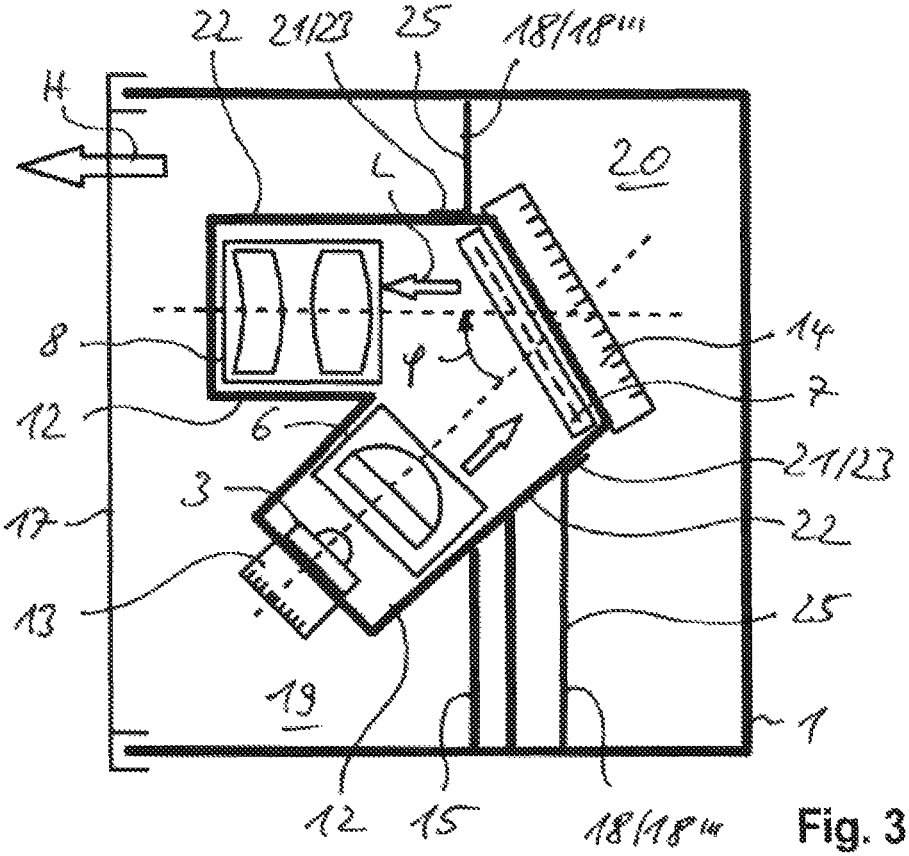
FIG. 3 is a schematic representation of an inventive lighting device according to an exemplary embodiment.

According to a first embodiment of the invention according to FIG. 1, a dividing wall 18' extends in a region close to the light source unit 2. In a second embodiment of the invention according to FIG. 2, a dividing wall 18" extends in a middle region between the light source unit 2 and the micromirror array 7. In an embodiment of the invention shown in FIG. 3, a dividing wall 18''' extends in a region close to the micromirror array 7.

The dividing wall 18, 18', 18", 18''' is frame-shaped, wherein free ends 21 of the dividing wall 18, 18', 18", 18''' are formed as resilient tabs, which are in contact with a wall 22 of the module housing 12. This creates a hermetic separation between the first chamber 19 and second chamber 20. The resilient tabs 21 may for example be formed of a flexible rubber material, wherein a side surface 23 of the bent rubber tab 21 rests against the wall 22. The resilient or flexible tab 21 may be integrally formed on a base portion 24 of the dividing wall 18, 18', 18", 18''', wherein the base portion 24 is made of a rigid material. The base portion 24 may be integrally connected to the housing 1.

According to an alternative embodiment of the invention, not shown, the dividing wall 18, 18', 18", 18" may be formed entirely of a flexible material, wherein the length of the dividing wall 18, 18', 18", 18" is chosen to be so great, that the free end 21 of the same rests against the wall 22 with its side surface 23 or engages in a groove of the wall 22.

The dividing wall 18, 18', 18", 18" may be made of plastic or of a glass material. It may be translucent or opaque.

According to an alternative embodiment of the invention, not shown, the dividing wall 18, 18', 18", 18" may also be disposed at an edge of a single housing of the light source unit 2 and/or the micromirror array 7.

The dividing wall 18, 18', 18", 18''' extends substantially transversely to the main emission direction H, so that its length can be minimized. The dividing wall 18" extends in an extension plane E, which runs perpendicular to the main emission direction H. The dividing wall 18' and 18''' comprises dividing wall sections 25, which are offset to one another in the main emission direction H.

The micromirror array 7 is operated with a thermal power loss, which is greater than zero and less than a thermal power loss of the light source unit 2. The dividing wall 18, 18', 18", 18" helps avoid heating of the micromirror array 7 due to heat dissipation from the light source unit 2 by circulating air within the housing 1. By means of the second cooling element 14, the micromirror array 7 can be kept at a lower temperature than if there were no dividing wall 18, 18', 18", 18'''.

According to a not-shown alternative embodiment of the invention, depending on the heat-dissipating optical elements of the lighting device, more than two chambers may be provided. The number of chambers coincides with the number of optical elements to be cooled.

The invention being thus described, it will be obvious that the same may be varied in many ways. Such variations are not to be regarded as a departure from the spirit and scope of the invention, and all such modifications as would be obvious to one skilled in the art are to be included within the scope of the following claims

What is claimed is:

1. A lighting device for vehicles comprising:

a housing having an opening on one side thereof;

a light source unit arranged in the housing, the light source unit emitting a light beam;

an optical unit arranged in the housing and being associated with the light source unit for generating a predetermined light distribution, the optical unit including a heat-dissipating optical element;

a cover plate closing the opening of the housing;

a first cooling element for dissipating heat from the light source unit;

a second cooling element being associated with the heat-dissipating optical element of the optical unit; and a dividing wall separating the housing into a first chamber and at least into a second chamber, wherein in the first chamber, the first cooling element associated with the light source unit is arranged, and in the second chamber, the second cooling element associated with the heat-dissipating optical element of the optical unit is arranged, and wherein the light beam is adapted to be guided in a light current direction from the light source unit to the heat-dissipating optical element and from the heat-dissipating optical element to the cover plate.

2. The lighting device according to claim 1, wherein the dividing wall is formed such that the first chamber is hermetically separated from the second chamber.

3. The lighting device according to claim 1, wherein the dividing wall includes a free end, the free end of the dividing wall being formed as a resilient tab resting against a wall or an edge of the light source unit or an edge of the heat-dissipating optical element.

4. The lighting device according to claim 3, wherein the resilient tab of the dividing wall is formed of a rubber material.

5. The lighting device according to claim 1, wherein the dividing wall is integrally connected to the housing.

6. The lighting device according to claim 1, wherein the dividing wall extends transversely to a main emission direction of the lighting device, and wherein the dividing wall is arranged circumferentially in an extension plane relative to the main emission direction.

7. The lighting device according to claim 1, wherein the dividing wall extends transversely to a main emission direction of the lighting device, wherein the dividing wall includes a plurality of dividing wall sections that are offset to one another in the main emission direction.

8. The lighting device according to claim 1, wherein the heat-dissipating optical element of the optical unit has a thermal power loss, which is greater than zero and less than a thermal power loss of the light source unit.

9. The lighting device according to claim 1, wherein the heat-dissipating optical element of the optical unit is a micromirror array with a plurality of individually controllable micromirrors, and wherein the optical unit comprises an illumination optic arranged light-upstream of the micromirror array and a projection optic arranged light-downstream of the micromirror array, and the lighting device further including a common module support provided inside of the housing, wherein the micromirror array, the illumination optic and the projection optic are surrounded by the common module support, wherein the dividing wall includes free ends, and wherein the free ends of the dividing wall rest against a wall of the module support.

10. The lighting device according to claim 1, wherein the dividing wall is formed of plastic or a glass material.

11. The lighting device according to claim 1, wherein the cover plate is spaced apart from the optical unit.

12. The lighting device according to claim 1, further including a common module support provided inside of the housing, wherein the light source unit and the optical unit are provided inside of the common module support, wherein the dividing wall includes a free end, and wherein the free end of the dividing wall rests against an exterior wall of the common module support.

13. The lighting device according to claim 1, wherein the optical unit further includes a projection optic and an illumination optic, wherein the heat-dissipating optical element is a micromirror array with a plurality of individually controllable micromirrors, and wherein the illumination optic is positioned light-upstream of the micromirror array and the projection optic is positioned light-downstream of the micromirror array.

* * * * *